United States Patent [19]

Diesch

[11] 4,106,716

[45] Aug. 15, 1978

[54] PAPER DRIVE MECHANISM FOR AUTOMATIC PHOTOGRAPHIC PAPER CUTTER

[75] Inventor: Robert E. Diesch, Rogers, Minn.

[73] Assignee: Pako Corporation, Minneapolis, Minn.

[21] Appl. No.: 837,987

[22] Filed: Sep. 29, 1977

[51] Int. Cl.[2] ..... B65H 25/22

[52] U.S. Cl. ..... 242/75.43; 242/56 R; 242/67.2

[58] Field of Search ..... 242/75.43, 75.4, 75.52, 242/76, 67.2, 67.3 R, 56 R; 226/43, 45, 195

[56] References Cited

U.S. PATENT DOCUMENTS

| | | | |
|---|---|---|---|
| 2,152,118 | 3/1939 | Walter | 242/76 |
| 3,116,032 | 12/1963 | Roberts | 242/75.43 |
| 3,556,368 | 1/1971 | Rene | 226/43 X |
| 3,715,085 | 2/1973 | Kobayashi | 242/56 R |
| 3,755,861 | 9/1973 | Castro | 242/75.52 |

*Primary Examiner*—Edward J. McCarthy
*Attorney, Agent, or Firm*—David R. Fairbairn; John W. Adams

[57] ABSTRACT

An automatic photographic paper cutter includes a drive system which drives a strip of photographic paper to a knife assembly. The drive mechanism applies a driving force along only one edge of the photographic paper strip, so that the operator of the paper cutter has an essentially unobstructed view of the prints on the photographic paper strip. A paper supply, which includes a spring loaded bale arm assembly, a pinch roller drive assembly, a brake, a motor and clutch, two loop sensors, and a U-shaped wire form guide supplies the photographic paper strip from a roll of photographic paper to the drive mechanism under essentially zero drag conditions.

14 Claims, 6 Drawing Figures

PAPER DRIVE MECHANISM FOR AUTOMATIC PHOTOGRAPHIC PAPER CUTTER

REFERENCE TO CO-PENDING APPLICATIONS

Reference is made to the following co-pending patent applications which are filed on even date with this application and are assigned to the same assignee as this application: "Microprocessor Controlled Photographic Paper Cutter", Ser. No. 838,064 by G. Strunc and F. Laciak; "Multichannel Indicia Sensor for Automatic Photographic Paper Cutter", Ser. No. 837,986 by R. Diesch and G. Strunc; "Stepper Motor Control", Ser. No. 837,988 by G. Strunc; "Print and Order Totalizer for Automatic Photographic Paper Cutter", Ser. No. 838,065 by G. Strunc; "Paper Feed Control for Automatic Photographic Paper Cutter", Ser. No. 838,000 by R. Diesch and G. Strunc; "Photographic Paper Cutter with Automatic Paper Feed in the Even of Occasional Missing Cut marks" by G. Strunc; and "Knife Assembly for Photographic Strip Cutter", Ser. No. 837,998 by R. Diesch. The subject matter of the present invention is disclosed but not claimed in these copending applications.

BACKGROUND OF THE INVENTION

The present invention relates to photographic processing equipment. In particular, the present invention relates to an improved paper supply and drive system for use in an automatic photographic paper cutter.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

A photographic paper cutter requires a paper supply and drive mechanism which withdraws the photographic paper strip from a roll and drives the paper to the knife assembly of the cutter. The desire for higher production has resulted in the development of automatic photographic paper cutters with increasingly higher speeds. For example, automatic paper cutters capable of cutting 25,000 prints per hour (i.e. over seven prints per second) are being developed. This places extreme demands on both the paper supply and paper drive mechanisms, and the need for improved paper supply and drive mechanisms becomes particularly apparent.

The drive mechanism of an automatic paper cutter must be capable of driving a paper strip extremely rapidly and accurately. Any inaccuracy in the drive mechanism may result in the photographic prints being cut at improper locations.

While the prior art drive mechanisms for photographic paper cutters have been generally satisfactory, they have had shortcomings. In particular, the typical prior art drive mechanism utilizes a drive roller in the center of the paper strip. This drive roller obscures the operator's view of the prints as they are moved toward the knife assembly. This is a particular disadvantage when the paper cutter is being used in conjunction with a print sorting apparatus, in which the prints which are cut are then sorted into good, remake, and reject categories.

In order for the paper drive mechanism to meet the stringent speed and accuracy requirements, the paper supply must supply the strip to the drive mechanism under essentially tension free or zero drag conditions. This requirement is complicated by the fact that the paper roll gets smaller as paper is withdrawn and, therefore, the weight of the roll and the resistance to withdrawal of paper from the roll is not constant. In the past, paper supply mechanisms have been developed which maintain a tension-free slack loop of the photographic paper strip between the supply roll and the drive mechanism. Examples of previous photographic paper supply mechanisms may be seen in U.S. Pat. No. 3,857,312 and 4,029,247.

SUMMARY OF THE INVENTION

The present invention is an improved paper supply and drive mechanism for use in automatic photographic paper cutters, and is particularly useful in paper cutters which operate at extremely high speeds. The drive mechanism of the present invention is based upon the discovery that a photographic paper strip can be driven accurately at extremely high speeds by applying a driving force at one edge only of the paper strip. This allows the operator an essentially unobstructed view of the prints on the paper strip as they are driven to the paper cutter knife assembly. This is an important advantage over the prior art paper drive systems, in which a roller applied a driving force at the center of the strip. The prior art drive mechanism obscured the operator's view of the prints on the photographic paper strip.

The preferred paper supply of the present invention includes a brake, a bale arm assembly, a bale arm position sensor, a drive roller and a pinch roller, a generally U-shaped guide, and first and second loop sensors. Paper from a paper roll is trained over the bale arm, between the drive and pinch rollers, and into the U-shaped guide, where a tension-free paper loop is formed. The bale arm position sensing means controls the brake, which controls rotation of the paper roll, as a function of the bale arm position. The first loop sensor causes the drive roller to begin driving the paper when the loop is less than a first predetermined length, and the second loop sensor causes the drive roller to stop driving the paper when the loop is longer than a second predetermined length.

BRIEF DESCRIPTION OF THE DRAWING

FIG. 1 is a perspective view of an automatic paper cutter utilizing the paper supply and drive mechanisms of the present invention.

FIG. 3 is a top view of the paper drive mechanism of the present invention.

DETAILED DESCRIPTION OF THE PREFERRED EMBODIMENTS

Figure 7:
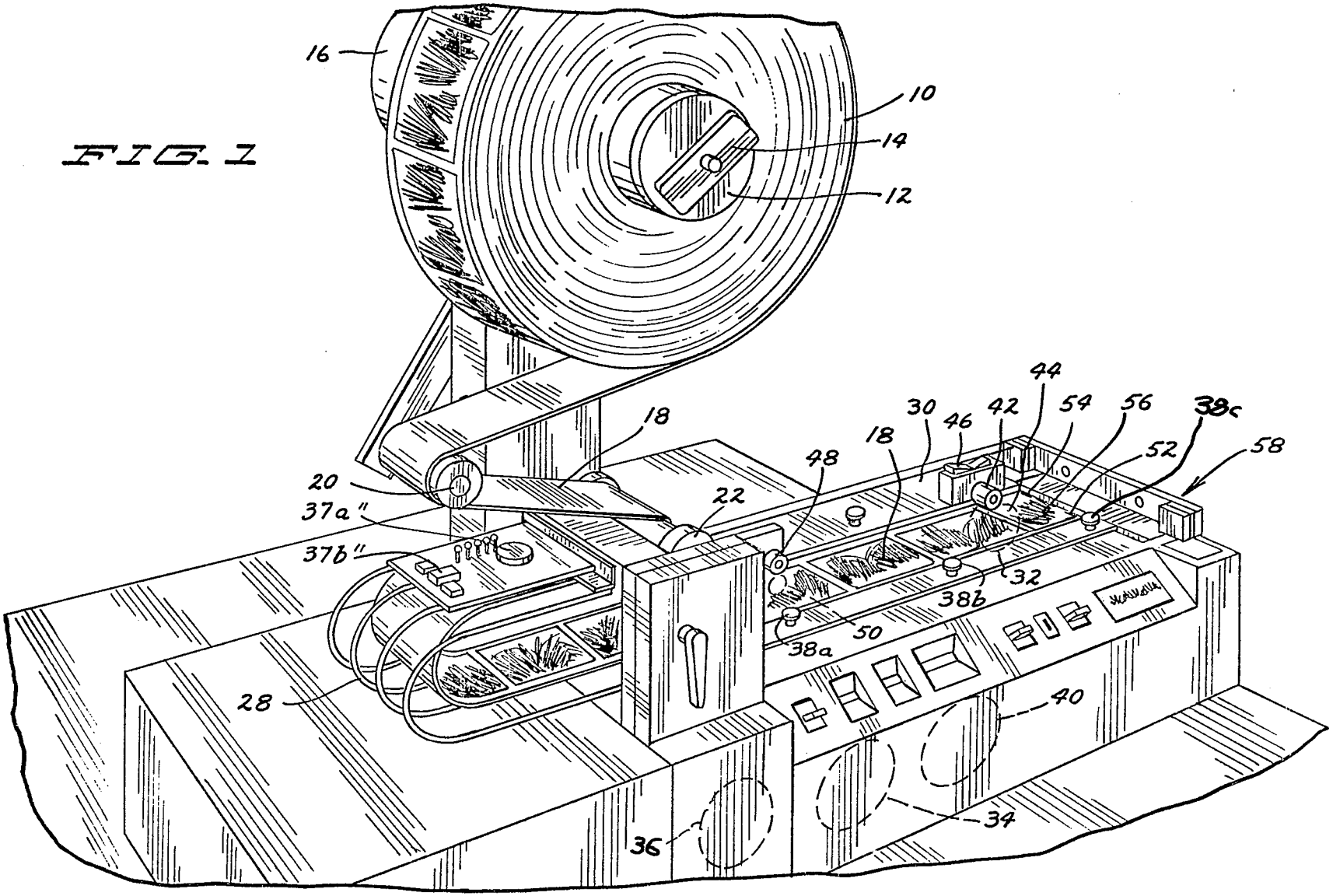

The paper supply and paper drive mechanisms of the present invention have been used successfully in a high speed, microprocessor controlled, automatic paper cutter which is capable of cutting prints at rates of 25,000 ($3\frac{1}{2}$ inch long) prints per hour. FIG. 1 is a perspective view of this high speed, microprocessor controlled, automatic paper cutter. The present application will not describe the electrical control system and the main and auxiliary control panels of the automatic paper cutter shown in FIG. 1. A detailed description of the electrical control system and the control panels may be found in the previously mentioned co-pending patent application Ser. No. 838,064 entitled "Microprocessor Controlled Photographic Paper Cutter" by G. Strunc.

In FIG. 1, the paper supply is an integral part of the paper cutter. A paper roll 10 is loaded from the front onto hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over spring-loaded bale arm assembly 20 and guide roller 22, between drive and idler pinch rollers 24 and 26 (shown in FIGS. 2A—2D), into generally U-shaped wire form retainer 28 where a tension-free loop is formed, and then to paper guides 30 and 32 of the paper drive mechanism. Pinch drive roller 24 is driven by the same AC motor 34 which drives the knife assembly of the paper cutter. The motor 34 drive is transmitted to pinch roller 24 through a belt drive and electro-mechanical clutch 36, which is controlled by first and second loop sensors 37*a* and 37*b*. When the clutch is energized to drive paper, brake 16 is de-energized by a bale arm position sensing snap action switch (not shown) to allow hub 12 to rotate. When the proper loop is generated, the clutch is de-energized and brake 16 is energized to prevent paper from unspooling off roll 10.

The paper supply assembly supplies paper strip 18 with essentially no drag or tension to the paper drive mechanism. This is important since the paper cutter operates at extremely high speeds, while requiring extremely accurate paper drive distances.

The paper drive mechanism includes paper guides 30 and 32, which receive paper strip 18 from the paper supply. Rear guide 30 is fixed and front guide 32 is movable so that various paper widths can be accommodated. Front paper guide 32 is adjusted by loosening thumbscrews 38*a*, 138*b*, and 38*c* and moving front guide 32 to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so that essentially the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of cut or end-of-order marks which appear on the back side of paper strip 18. Operation of the automatic paper cutter is controlled by the CUT and END signals produced by the indicia sensor assemblies.

The knife assembly 58 includes a base, spring-wrap clutch mechanism, AC motor 34 (which also drives pinch roller 24 of the paper supply), a main drive shaft, two crank arm assemblies, two vertical drive shafts, blade mount, and interchangeable blades. One blade is used for cutting straight-bordered and straight-borderless prints, and the other blade is used for cutting round-cornered borderless prints.

Figure 2B:
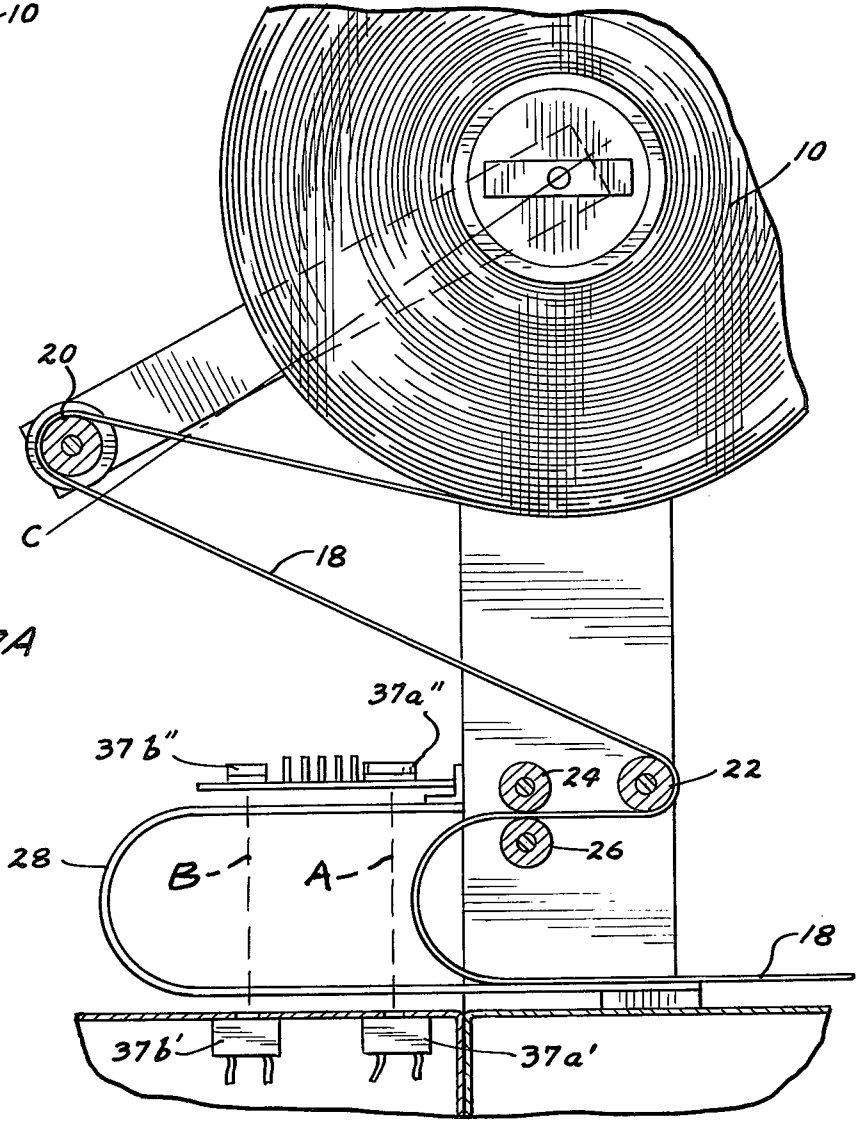
FIGS. 2A—2D are front views illustrating the operation of the paper supply shown in FIG. 1.
Figure 2A:
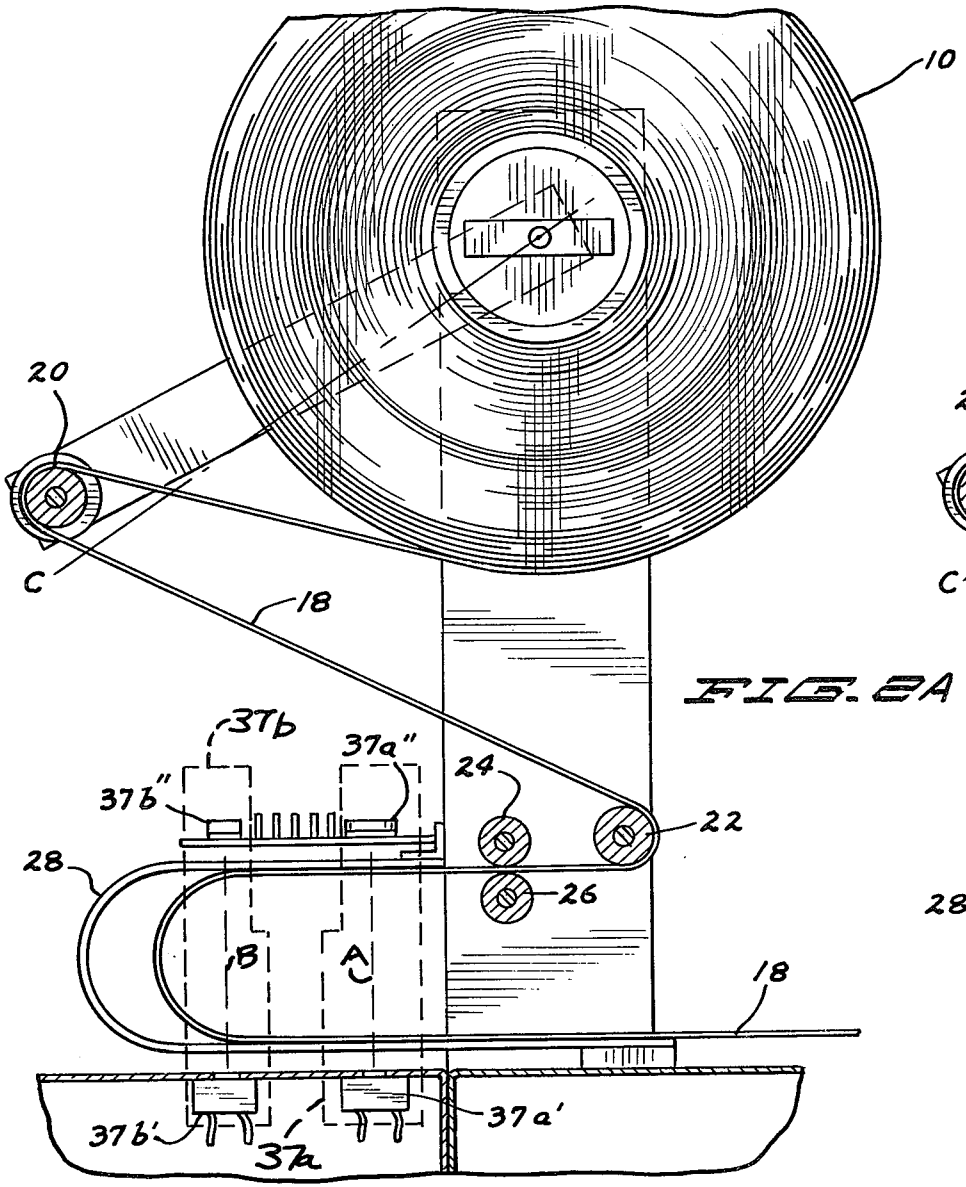

FIGS. 2A—2D illustrate the operation of the paper supply of the present invention. FIG. 2A shows the paper supply in a rest condition in which brake 16 is energized and clutch 36 is de-energized. The tension free slack loop within wire form retainer 28 is beyond a first predetermined length A and a second predetermined length B. First length A is determined by the position of the first loop sensor assembly 37*a*, which in a preferred embodiment includes a light source 37*a'* and light detector 37*a''*. Similarly, the second length B is defined by the second loop sensor assembly 37*b*, which is formed by light source 37*b'* and light detector 37*b''*.

The operation of clutch 36 is controlled by the outputs of detectors 37*a''* and 37*b''*. When, as shown in FIG. 2A, the loop extends past second length B, so that paper strip 18 interrupts the light being received by detector 37*b''* from light source 37*b'*, the clutch is de-energized and no driving force is applied to drive roller 24.

In the condition shown in FIG. 2A, brake 16 is energized, thereby preventing movement of roll 10 because bale arm assembly 20 is beyond position C. In a preferred embodiment, the position of bale arm assembly 20 is sensed by a snap action switch. Bale arm assembly 20 includes a spring which urges the bale arm in the clockwise direction as shown in FIG. 2A.

When a print-feed-and-cut cycle is commenced by the paper cutter, the tension-free end of paper strip 18 is advanced toward the knife assembly. This causes the tension-free loop to shorten, since the clutch is still de-energized and brake 16 is still energized. The loop continues to shorten until it is shorter than first length A. This condition is shown in FIG. 2B. When detector 37*a''* begins to receive light from light source 37*a '*, the output from detector 37*a''* causes the clutch to be energized. Drive roller 24 begins to drive the paper so as to increase the length of the slack loop.

Figure 2D:
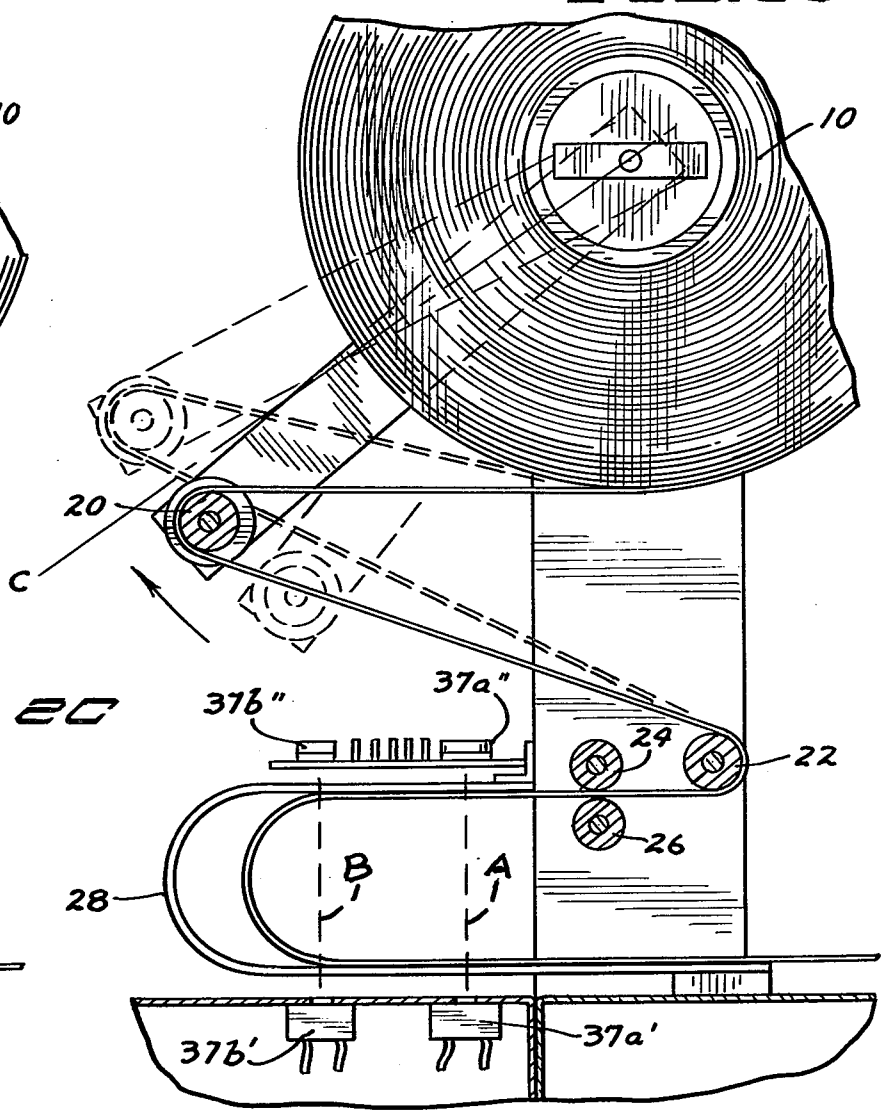
Figure 2C:
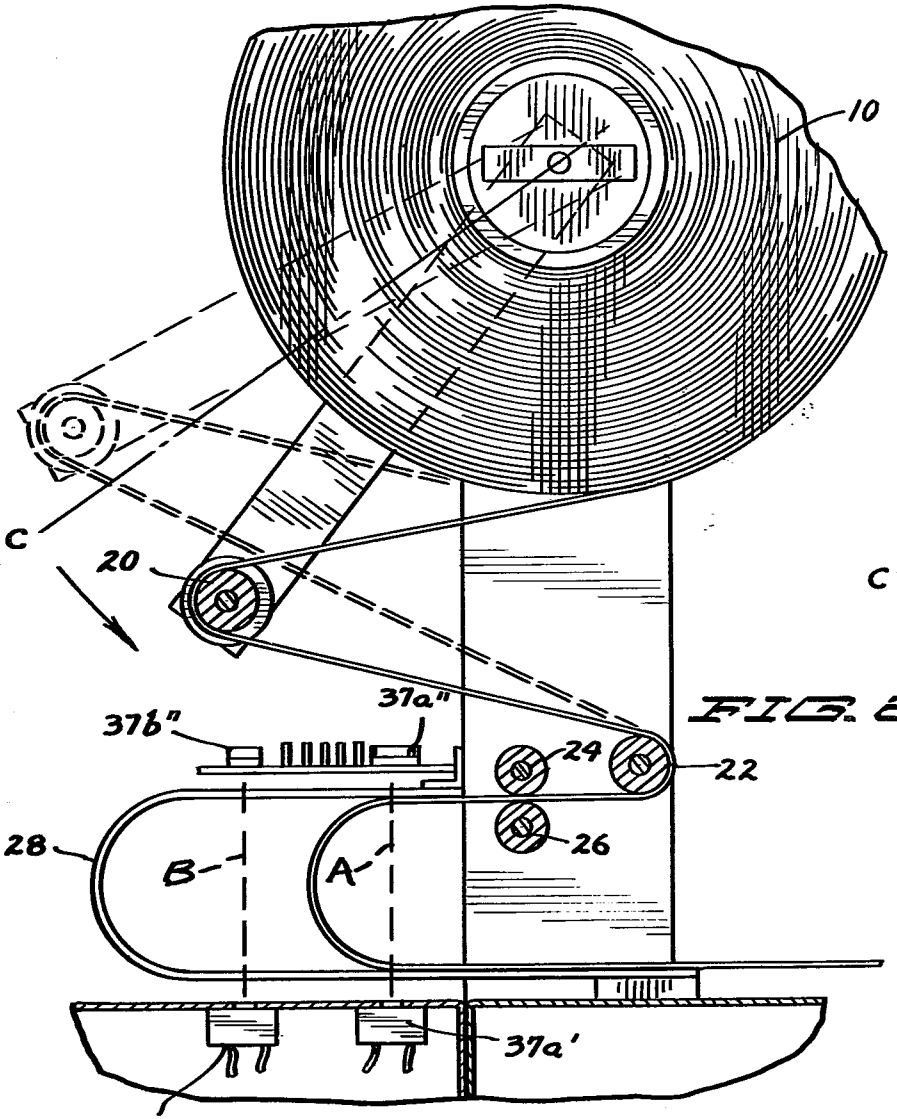
Figure 4:
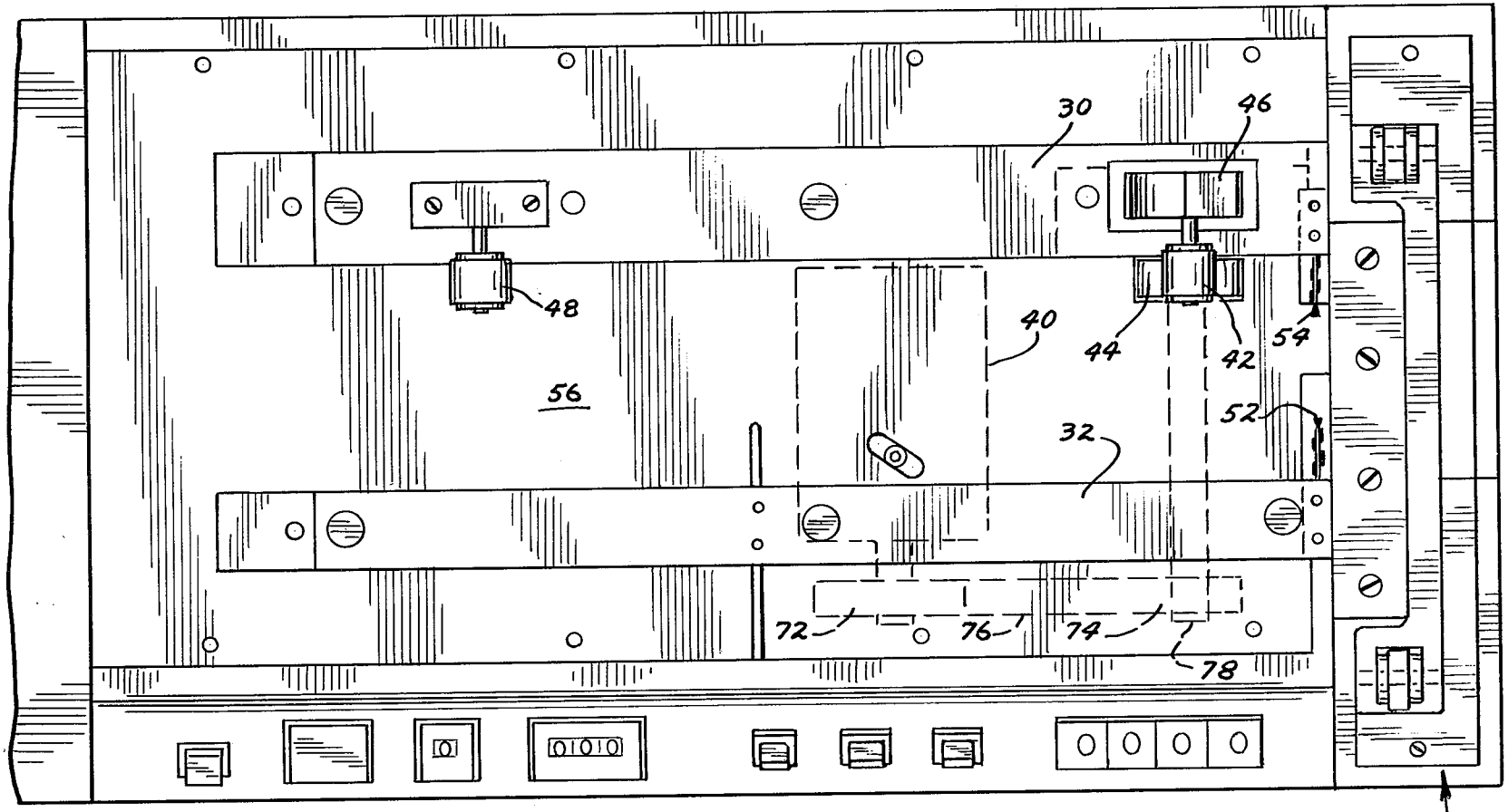

FIG. 2C shows the condition of the paper supply after drive roller 24 has begun to lengthen the slack loop. Since brake 16 was still energized when the clutch was initially energized, the driving of the paper by drive roller 24 causes bale arm assembly 20 to be pulled downward toward drive roller 22. When bale arm assembly 20 passes point C, as sensed by the bale arm position sensing snap action switch, brake 16 is de-energized, thereby allowing hub 12 and roll 10 to rotate. In the condition shown in FIG. 2C, brake 16 is de-energized and the clutch is energized.

Drive roller 24 continues to drive paper strip 18 until the loop interrupts the length between light source 37*b'* and detector 37*b''*. When the loop exceeds second length B, the output of detector 37*b''* causes clutch 36 to be de-energized, thereby stopping drive roller 24. The hysteresis provided by loop sensor assemblies 37*a* and 37*b* is particularly important for high speed paper drive applications. In one preferred embodiment, sensor assembly 37*a* is spaced approximately $1\frac{1}{4}$ inches from drive roller 24 and sensor assembly 37*b* is spaced approximately 3¼ inches beyond sensor assembly 37*a*.

In the condition shown in FIGS. 2D, the clutch is de-energized and brake 16 is still de-energized. Brake 16 remains de-energized after the clutch has been de-energized until sufficient length of strip 18 has been fed off roll 10 to allow bale arm 20 to be urged past position C by the spring. When bale arm 20 passes position C, brake 16 is energized, thereby preventing any further unspooling of paper from roll 10. The condition of the paper supply will then have returned to the state shown in FIG. 2A, and will remain in that state until further paper demand from the paper cutter drive mechanism occurs. Two paper feed-and-cut cycles will generally cause a repetition of the paper supply cycle illustrated in FIGS. 2A–2D.

FIG. 3 shows a top view of the drive mechanism of the present invention. The drive mechanism of FIG. 3 has been used successfully in driving photographic print paper at speeds sufficient to allow cutting of 25,000 3½ inch long prints per hour (i.e. over 7 prints per second). The drive mechanism provides high speed paper drive with accuracy of ±0.010 inch. This highly accurate and high speed paper drive is achieved while only applying driving force to the rear edge of the paper strip. As a result, the drive mechanism of the present invention, unlike prior art drive mechanisms, permits an essentially unobstructed view of paper strip 18. This is a particularly advantageous feature when the paper cutter is being used in conjunction with print sorting apparatus.

As shown in FIG. 3, stepper motor 40 supplies drive force to drive roller 44 by means of pulleys 72 and 74, timing belt 76, and shaft 78. Paper strip 18 passes between idler roller 42 and drive roller 44, with drive roller positioned below idler roller 42. Lever 46 controls the position of idler roller 44 so that idler roller 44 is in the engaged position for operation and in the disengged position for loading paper, shipping, and other nonoperating modes.

With the paper drive system of the present invention, in which the driving force is applied only at the rear edge of strip 18, it has been found that additional guidance of the paper strip is desirable. Idler rollers 48 and 50 are located between rollers 42 and 44 and the paper supply. Idler rollers 48 and 50 provide the desired additional guidance of the paper strip to avoid misalignment or binding of paper strip 18 in guides 30 and 32.

In conclusion, the paper supply and drive mechanisms of the present invention permit highly accurate, high speed driving of paper which is necessary for high speed automatic photographic paper cutters. Although the present invention has been described with reference to preferred embodiments, workers skilled in the art will recognize that changes may be made in form and detail without departing from the spirit and scope of the invention. For example, although the paper supply and paper drive mechanisms of the present invention are particularly useful when used in conjunction with one another, each may be used separately as well. For example, the paper supply of the present invention can be used in conjunction with the prior art paper drive systems and, similarly, the paper drive mechanism of the present invention can be used in conjunction with other paper supplies.

What is claimed is:

1. A paper drive system for a photographic paper cutter, the paper drive system comprising:

paper supply means for supplying a strip of photographic print paper;

guide means for guiding the strip along a path; and paper drive means proximate a first edge of the strip for driving the strip along the path by applying a driving force to the strip only at the first edge.

2. The paper drive system of claim 1 wherein the paper drive means comprises:

first pinch roller means proximate the first edge; and motor means for driving the first pinch roller means.

3. The paper drive system of claim 2 wherein the first pinch roller means comprises:

first idler roller means; and drive roller means driven by the motor means.

4. The paper drive system of claim 3 wherein the motor means comprises a stepper motor.

5. The paper drive system of claim 2 wherein a first pinch roller means engages the paper strip only proximate the first edge and permits a substantially unobstructed view of the entire paper strip.

6. The paper drive system of claim 2 and further comprising:

second pinch roller means positioned along the path of the strip between the paper supply means and the first pinch roller means, the second pinch roller means engaging the strip only proximate the first edge.

7. The paper drive system of claim 6 wherein the second pinch roller means comprises second and third idler roller means.

8. The photographic paper cutter of claim 1 wherein the paper supply means supplies a strip of photographic print paper from a paper roll in response to demand from the paper drive means.

9. The photographic paper cutter of claim 8 wherein the paper supply means comprises:

brake means for controlling the rotation of the paper roll;

bale arm means for receiving the strip from the paper roll;

bale arm position sensing means controlling the brake means as a function of the bale arm means position;

paper supply drive roller means for receiving the strip from the bale arm means and applying a driving force to the strip;

pressure roller means for maintaining a positive driving connection between the strip and the paper supply drive roller means;

paper supply motor means for driving the paper supply drive roller;

loop forming means for causing the strip to form a tension-free slack loop downstream from the paper supply drive roller means;

first loop sensor means for sensing the position of the loop and causing the paper supply motor means to begin driving the paper supply motor means when the loop becomes shorter than a first predetermined length; and second loop sensor means for sensing the position of the loop and causing the paper supply motor means to discontinue driving the paper supply drive roller means when the loop becomes longer than a second predetermined length.

10. The photographic paper cutter of claim 9 and further comprising:

guide roller means positioned between the bale arm means and the paper supply drive roller means for guiding the strip from the bale arm means to the paper supply drive roller means.

11. The photographic paper cutter of claim 9 wherein the paper supply motor means comprises:

a motor; and clutch means for controlling drive from the motor to the paper supply drive roller means as a function of signals from the first and second loop sensor means.

12. In a photographic paper cutter having paper drive means for driving a strip of photographic paper, and knife means for cutting the strip, paper supply means for supplying the strip from a paper roll in response to demand from the paper drive means, the paper supply means comprising:

brake means for controlling the rotation of the paper roll;

bale arm means for receiving the strip from the paper roll;

bale arm position sensing means controlling the brake means as a function of the bale arm means position;

paper supply drive roller means for receiving the strip from the bale arm means and applying a driving force to the strip;

pressure roller means for maintaining a positive driving connection between the strip and the paper supply driver roller means;

paper supply motor means for driving the paper supply drive roller;

loop forming means for causing the strip to form a tension-free slack loop downstream from the paper supply drive roller means;

first loop sensor means for sensing the position of the loop and causing the paper supply motor means to begin driving the paper supply drive roller means when the loop becomes shorter than a first predetermined length; and second loop sensor means for sensing the position of the loop and causing the paper supply motor means to discontinue driving the paper supply drive roller means when the loop becomes longer than a second predetermined length.

13. The photographic paper cutter of claim 12 and further comprising:

guide roller means positioned between the bale arm means and the paper supply drive roller means for guiding the strip from the bale arm means to the paper supply drive roller means.

14. The photographic paper cutter of claim 12 wherein the paper supply motor means comprises:

a motor; and clutch means for controlling drive from the motor to the paper supply drive roller means as a function of signals from the first and second loop sensor means.

* * * * *